US011980942B2

(12) United States Patent
Yoo et al.

(10) Patent No.: US 11,980,942 B2
(45) Date of Patent: May 14, 2024

(54) METHOD FOR MANUFACTURING METAL FOAM

(71) Applicant: LG CHEM, LTD., Seoul (KR)

(72) Inventors: Dong Woo Yoo, Daejeon (KR); Jin Kyu Lee, Daejeon (KR)

(73) Assignee: LG Chem, LTD., Seoul (KR)

( * ) Notice: Subject to any disclaimer, the term of this patent is extended or adjusted under 35 U.S.C. 154(b) by 564 days.

(21) Appl. No.: 16/348,762

(22) PCT Filed: Nov. 29, 2017

(86) PCT No.: PCT/KR2017/013733
§ 371 (c)(1),
(2) Date: May 9, 2019

(87) PCT Pub. No.: WO2018/101715
PCT Pub. Date: Jun. 7, 2018

(65) Prior Publication Data

US 2020/0055120 A1 Feb. 20, 2020

(30) Foreign Application Priority Data

Nov. 30, 2016 (KR) ..... 10-2016-0162154

(51) Int. Cl.
*B22F 3/11* (2006.01)
*B22F 3/105* (2006.01)
*B22F 5/00* (2006.01)

(52) U.S. Cl.
CPC ..... *B22F 3/1137* (2013.01); *B22F 3/105* (2013.01); *B22F 5/006* (2013.01); *B22F 2003/1053* (2013.01)

(58) Field of Classification Search
CPC ..... C22C 1/08; C22C 2001/081; C22C 2001/082; C22C 2001/083;
(Continued)

(56) References Cited

U.S. PATENT DOCUMENTS 2,689,178 A * 9/1954 Hignett ..... B22F 3/11 210/490
4,957,543 A * 9/1990 Babjak ..... B22F 3/1137 428/614
(Continued)

FOREIGN PATENT DOCUMENTS

CN 1133895 10/1996
DE 3015981 A1 * 11/1981 ..... H01M 4/04
(Continued)

OTHER PUBLICATIONS

Peter A. Hassell and Nicholas V. Ross, "Induction Heat Treating of Steel," ASM Handbooks (online), vol. 4, 2002, 55 pages total. (Year: 2002).*
(Continued)

*Primary Examiner* — Vanessa T. Luk
(74) *Attorney, Agent, or Firm* — SALIWANCHIK, LLOYD & EISENSCHENK

(57) ABSTRACT

The present application provides a method for manufacturing a metal foam. The present application can provide a method for manufacturing a metal foam, which is capable of forming in a very short time a metal foam comprising uniformly formed pores and having excellent mechanical properties as well as the desired porosity, and a metal foam produced by the above method. In addition, the present application can provide a method capable of forming a metal foam in which the above-mentioned physical properties are ensured, while being in the form of a thin film or sheet, in a short time, and such a metal foam.

10 Claims, 1 Drawing Sheet

(58) Field of Classification Search
CPC ..... C22C 2001/085; C22C 2001/086; C22C 2001/087; C22C 2001/088; B22F 3/11; B22F 3/1103; B22F 3/1109; B22F 3/1112; B22F 3/1115; B22F 3/1118; B22F 3/1121; B22F 3/1125; B22F 3/1134; B22F 3/1137; B22F 3/114; B22F 3/1143; B22F 3/1146; B22F 2003/1106; B22F 2003/1128; B22F 2003/1131; B22F 7/002; B22F 7/004; B22F 7/006; B22F 2003/1053; B22F 2202/07; C25D 3/12; C25D 3/14; C25D 3/16; C25D 3/18
See application file for complete search history.

(56) References Cited

U.S. PATENT DOCUMENTS

| | | | | | |
|---|---|---|---|---|---|
| 5,640,669 | A * | 6/1997 | Harada | C25D 7/00 419/37 |
| 6,166,360 | A * | 12/2000 | Ruffini, Sr. | C21D 9/0068 219/601 |
| 6,387,149 | B1 * | 5/2002 | Harada | B22F 3/1137 419/14 |
| 2004/0074338 | A1 | 4/2004 | Kuhn et al. | |
| 2007/0051636 | A1 * | 3/2007 | Paserin | C23C 14/046 205/159 |
| 2007/0099020 | A1 | 5/2007 | Karl et al. | |
| 2012/0141670 | A1 * | 6/2012 | Walther | C22C 38/06 427/180 |
| 2013/0171466 | A1 | 7/2013 | Maffia | |
| 2013/0266862 | A1 * | 10/2013 | Okuno | C25D 1/08 429/211 |
| 2014/0182808 | A1 | 7/2014 | Choi et al. | |
| 2015/0334781 | A1 * | 11/2015 | Verhagen | H05B 6/102 219/667 |
| 2018/0093318 | A1 * | 4/2018 | Hiraiwa | H01M 8/0232 |

FOREIGN PATENT DOCUMENTS

| | | | | |
|---|---|---|---|---|
| EP | 1477578 | | 11/2004 | |
| EP | 1500450 | A1 * | 1/2005 | B22F 3/114 |
| FR | 2081653 | A1 * | 12/1971 | C22C 1/08 |
| GB | 762670 | A * | 12/1956 | |
| JP | 02254106 | A * | 10/1990 | C04B 38/0615 |
| JP | H02254106 | | 10/1990 | |
| JP | H0330259 | | 2/1991 | |
| JP | H05339605 | | 12/1993 | |
| JP | H06287608 | | 10/1994 | |
| JP | 08134506 | A * | 5/1996 | B22F 3/1137 |
| JP | 10165311 | | 6/1998 | |
| JP | 2005290494 | | 10/2005 | |
| JP | 3735898 | | 1/2006 | |
| JP | 2009102701 | | 5/2009 | |
| JP | 2012036503 | A | 2/2012 | |
| JP | 4924997 | | 4/2012 | |
| JP | 2015117391 | A | 6/2015 | |
| KR | 100395036 | | 8/2003 | |

OTHER PUBLICATIONS

"Glossary of Metallurgical and Metalworking Terms," Metals Handbook, ASM Handbooks Online, ASM International, 2002, pp. 1, 82, 83, 257. (Year: 2002).*

Japanese Office Action corresponding to JP 2019-545224; dated Jan. 18, 2021 (6 pages, including English translation).

Extended European'Search Report corresponding to EP 17876178.9, dated Sep. 12, 2019 (7 pp).

International Search Report of the International Searching Authority corresponding to International Patent Application No. PCT/KR2017/013733, dated Apr. 12, 2018. (5 pages with English translation).

* cited by examiner

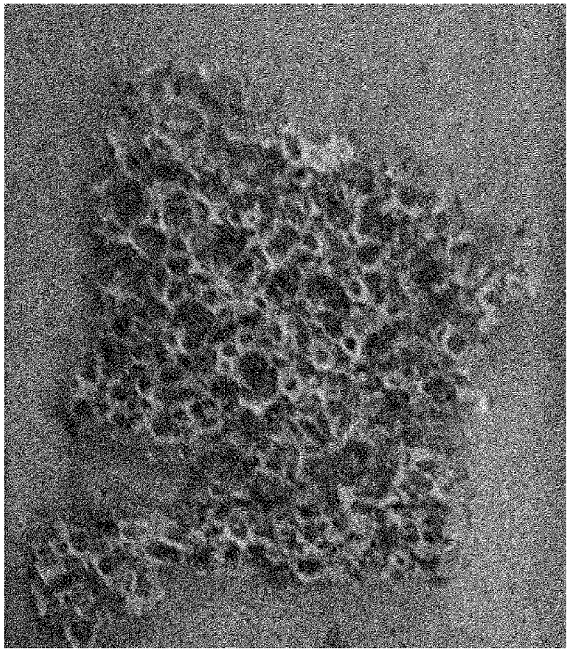

METHOD FOR MANUFACTURING METAL FOAM

CROSS REFERENCE TO RELATED APPLICATIONS

This application is a 35 U.S.C. § 371 national stage application of PCT International Application No. PCT/KR2017/013733, filed Nov. 29, 2017, which claims priority from Korean Patent Application No. 10-2016-0162154, filed Nov. 30, 2016, the contents of which are incorporated herein in their entireties by reference. The above-referenced PCT International Application was published in the Korean language as International Publication No. WO 2018/101715 A1 on Jun. 7, 2018.

TECHNICAL FIELD

The present application relates to a method for manufacturing a metal foam and a metal foam.

BACKGROUND ART

Metal foams can be applied to various fields including lightweight structures, transportation machines, building materials or energy absorbing devices, and the like by having various and useful properties such as lightweight properties, energy absorbing properties, heat insulating properties, refractoriness or environment-friendliness. In addition, metal foams not only have a high specific surface area, but also can further improve the flow of fluids, such as liquids and gases, or electrons, and thus can also be usefully used by being applied in a substrate for a heat exchanger, a catalyst, a sensor, an actuator, a secondary battery, a gas diffusion layer (GDL) or a microfluidic flow controller, and the like.

DISCLOSURE

Technical Problem

It is an object of the present invention to provide a method capable of manufacturing a metal foam comprising pores uniformly formed and having excellent mechanical strength as well as a desired porosity.

Technical Solution

In the present application, the term metal foam or metal skeleton means a porous structure comprising two or more metals as a main component. Here, the metal as a main component means that the proportion of the metal is 55 wt % or more, 60 wt % or more, 65 wt % or more, 70 wt % or more, 75 wt % or more, 80 wt % or more, 85 wt % or more, 90 wt % or more, or 95 wt % or more based on the total weight of the metal foam or the metal skeleton. The upper limit of the proportion of the metal contained as the main component is not particularly limited and may be, for example, 100 wt %.

The term porous property may mean a case where porosity is 30% or more, 40% or more, 50% or more, 60% or more, 70% or more, 75% or more, or 80% or more. The upper limit of the porosity is not particularly limited, and may be, for example, less than about 100%, about 99% or less, or about 98% or less or so. Here, the porosity can be calculated in a known manner by calculating the density of the metal foam or the like.

The method for manufacturing a metal foam of the present application may comprise a step of sintering a green structure comprising a metal component having metals. In the present application, the term green structure means a structure before the process performed to form the metal foam, such as the sintering process, that is, a structure before the metal foam is formed. In addition, even when the green structure is referred to as a porous green structure, the structure is not necessarily porous per se, and may be referred to as a porous green structure for convenience, if it can finally form a metal foam, which is a porous metal structure.

In the present application, the green structure may comprise a polymer foam and a layer of a metal component formed on the surface of the polymer foam. When the green structure having such a shape is applied to a sintering process and sintered while decomposing and removing the polymer foam by heat, the metal foam having the desired structure may be obtained.

The green structure may be formed by coating a metal component on the surface of a suitable polymer foam. At this time, the kind or shape, and the like of the applied polymer foam is not particularly limited, which may be selected according to the desired metal foam. For example, as the polymer foam, a foam of a material that may be effectively removed by heat upon sintering by induction heating to be described below, can be applied. In addition, the shape of the polymer foam may be selected according to the shape of the desired metal foam, and physical properties such as porosity may also be selected in consideration of the porosity of the desired metal foam or the like. The type of polymer foam that can be applied may be a polyurethane foam, an acrylic foam, a polystyrene foam, a polyolefin foam such as a polyethylene foam or a polypropylene foam, a polycarbonate foam, or a polyvinyl chloride foam, but is not limited thereto.

In one example, the polymer foam may be in the form of a film or sheet. The shape of the metal foam thus produced may also be a film or a sheet. For example, when the polymer foam is in the form of a film or sheet, the thickness may be 2,000 μm or less, 1,500 μm or less, 1,000 μm or less, 900 μm or less, 800 μm or less, 700 μm or less, 600 μm or less, 500 μm or less, 400 μm or less, 300 μm or less, 200 μm or less, 150 μm or less, about 100 μm or less, about 90 μm or less, about 80 μm or less, about 70 μm or less, about 60 μm or less, or about 55 μm or less. Metal foams have generally brittle characteristics due to their porous structural features, so that there are problems that they are difficult to be manufactured in the form of films or sheets, particularly thin films or sheets, and are easily broken even when they are made. However, according to the method of the present application, it is possible to form a metal foam having pores uniformly formed inside and excellent mechanical properties as well as a thin thickness.

Here, the lower limit of the thickness of the polymer foam is not particularly limited. For example, the film or sheet form may have a thickness of about 5 μm or more, 10 μm or more, or about 15 μm or more.

The method of forming a layer of a metal component on the surface of such a polymer foam is not particularly limited. Various methods for forming a metal coating layer on the surface of a polymer are known in the industry, and all of these methods can be applied. The method can be exemplified by a plating method such as electrolytic or electroless plating or a method of spray-coating a metal component in a slurry or powder state, and the like.

Accordingly, the green structure may be formed by a method comprising a step of spraying a metal component on the polymer foam; or plating a metal component on the polymer foam.

In one example, as the metal component forming a layer on the surface of a polymer foam, a metal component comprising at least a metal having appropriate relative magnetic permeability and conductivity may be used. According to one example of the present application, the application of such a metal can ensure that when an induction heating method to be described below is applied as the sintering, the sintering according to the relevant method is smoothly carried out.

For example, as the metal, a metal having a relative magnetic permeability of 90 or more may be used. Here, the relative magnetic permeability ($\mu_r$) is a ratio ($\mu/\mu_0$) of the magnetic permeability ($\mu$) of the relevant material to the magnetic permeability ($\mu_0$) in the vacuum. The metal used in the present application may have a relative magnetic permeability of 95 or more, 100 or more, 110 or more, 120 or more, 130 or more, 140 or more, 150 or more, 160 or more, 170 or more, 180 or more, 190 or more, 200 or more, 210 or more, 220 or more, 230 or more, 240 or more, 250 or more, 260 or more, 270 or more, 280 or more, 290 or more, 300 or more, 310 or more, 320 or more, 330 or more, 340 or more, 350 or more, 360 or more, 370 or more, 380 or more, 390 or more, 400 or more, 410 or more, 420 or more, 430 or more, 440 or more, 450 or more, 460 or more, 470 or more, 480 or more, 490 or more, 500 or more, 510 or more, 520 or more, 530 or more, 540 or more, 550 or more, 560 or more, 570 or more, 580 or more, or 590 or more. The upper limit of the relative magnetic permeability is not particularly limited because the higher the value is, the higher the heat is generated when the electromagnetic field for induction heating as described below is applied. In one example, the upper limit of the relative magnetic permeability may be, for example, about 300,000 or less.

The metal may be a conductive metal. In the present application, the term conductive metal may mean a metal having a conductivity at 20° C. of about 8 MS/m or more, 9 MS/m or more, 10 MS/m or more, 11 MS/m or more, 12 MS/m or more, 13 MS/m or more, or 14.5 MS/m, or an alloy thereof. The upper limit of the conductivity is not particularly limited, and for example, may be about 30 MS/m or less, 25 MS/m or less, or 20 MS/m or less.

In the present application, the metal having the relative magnetic permeability and conductivity as above may also be simply referred to as a conductive magnetic metal.

By applying the conductive magnetic metal, sintering can be more effectively performed when the induction heating process to be described below proceeds. Such a metal can be exemplified by nickel, iron or cobalt, and the like, but is not limited thereto.

The metal component may comprise, if necessary, a second metal different from the conductive magnetic metal together with the metal. In this case, the metal foam may be formed of a metal alloy. As the second metal, a metal having the relative magnetic permeability and/or conductivity in the same range as the above-mentioned conductive magnetic metal may also be used, and a metal having the relative magnetic permeability and/or conductivity outside the range may be used. In addition, the second metal may also comprise one or two or more metals. The kind of the second metal is not particularly limited as long as it is different from the applied conductive magnetic metal, and for example, one or more metals, different from the conductive magnetic metal, of copper, phosphorus, molybdenum, zinc, manganese, chromium, indium, tin, silver, platinum, gold, aluminum or magnesium, and the like may be applied, without being limited thereto.

The ratio of the conductive magnetic metal in the metal component is not particularly limited. For example, the ratio may be adjusted so that the ratio may generate an appropriate Joule heat upon application of the induction heating method to be described below. For example, the metal component may comprise 30 wt % or more of the conductive magnetic metal based on the weight of the total metal component. In another example, the ratio of the conductive magnetic metal in the metal component may be about 35 wt % or more, about 40 wt % or more, about 45 wt % or more, about 50 wt % or more, about 55 wt % or more, 60 wt % or more, 65 wt % or more, 70 wt % or more, 75 wt % or more, 80 wt % or more, 85 wt % or more, or 90 wt % or more. The upper limit of the conductive magnetic metal ratio is not particularly limited, and may be, for example, less than about 100 wt %, or 95 wt % or less. However, the above ratios are exemplary ratios. For example, since the heat generated by induction heating due to application of an electromagnetic field can be adjusted according to the strength of the electromagnetic field applied, the electrical conductivity and resistance of the metal, and the like, the ratio can be changed depending on specific conditions.

The metal component forming the green structure may be in the form of powder. For example, the metals in the metal component may have an average particle diameter in a range of about 0.1 μm to about 200 μm. In another example, the average particle diameter may be about 0.5 μm or more, about 1 μm or more, about 2 μm or more, about 3 μm or more, about 4 μm or more, about 5 μm or more, about 6 μm or more, about 7 μm or more, or about 8 μm or more. In another example, the average particle diameter may be about 150 μm or less, 100 μm or less, 90 μm or less, 80 μm or less, 70 μm or less, 60 μm or less, 50 μm or less, 40 μm or less, 30 μm or less, or 20 μm or less. As the metal in the metal component, one having different average particle diameters may also be applied. The average particle diameter can be selected from an appropriate range in consideration of the shape of the desired metal foam, for example, the thickness or porosity of the metal foam, and the like, which is not particularly limited.

Also, in forming the green structure, the metal component on the polymer foam may be formed by spray-coating only the metal component as above, or electrolytic or electroless plating it, and may be formed, if necessary, using a slurry prepared by mixing the metal component with a suitable binder and/or solvent. The type of the solvent or binder to be applied in this process is not particularly limited, and a suitable type can be selected in consideration of dispersibility or the like of the metal component.

The green structure as above may be sintered to produce a metal foam. In this case, the sintering for producing the metal foam can be performed by the induction heating method described below. Accordingly, the sintering step may comprise a step of applying an electromagnetic field to the green structure and sintering the metal component by heat generated by induction heating of the conductive metal.

As described above, the metal component comprises the conductive magnetic metal having the predetermined magnetic permeability and conductivity, and thus the induction heating method can be applied. By such a method, it is possible to smoothly manufacture metal foams having excellent mechanical properties and whose porosity is controlled to the desired level as well as comprising uniformly formed pores. Particularly, according to this method, unlike the conventional method, it is possible to form the metal foam with excellent physical properties in a very short time.

Here, the induction heating is a phenomenon in which heat is generated from a specific metal when an electromagnetic field is applied. For example, if an electromagnetic field is applied to a metal having a proper conductivity and magnetic permeability, eddy currents are generated in the metal, and Joule heating occurs due to the resistance of the metal. In the present application, a sintering process through such a phenomenon can be performed. In the present application, the sintering of the metal foam can be performed in a short time by applying such a method, thereby ensuring the processability, and at the same time, the metal foam having excellent mechanical strength as well as being in the form of a thin film having a high porosity can be produced.

Thus, the sintering process may comprise a step of applying an electromagnetic field to the green structure. By the application of the electromagnetic field, Joule heat is generated by the induction heating phenomenon in the conductive magnetic metal of the metal component, whereby the structure can be sintered. At this time, the conditions for applying the electromagnetic field are not particularly limited as they are determined depending on the kind and ratio of the conductive magnetic metal in the green structure, and the like. For example, the induction heating can be performed using an induction heater formed in the form of a coil or the like. In addition, the induction heating can be performed, for example, by applying a current of 100 A to 1,000 A or so. In another example, the applied current may have a magnitude of 900 A or less, 800 A or less, 700 A or less, 600 A or less, 500 A or less, or 400 A or less. In another example, the current may have a magnitude of about 150 A or more, about 200 A or more, or about 250 A or more.

The induction heating can be performed, for example, at a frequency of about 100 kHz to 1,000 kHz. In another example, the frequency may be 900 kHz or less, 800 kHz or less, 700 kHz or less, 600 kHz or less, 500 kHz or less, or 450 kHz or less. In another example, the frequency may be about 150 kHz or more, about 200 kHz or more, or about 250 kHz or more.

The application of the electromagnetic field for the induction heating can be performed within a range of, for example, about 1 minute to 10 hours. In another example, the application time may be about 9 hours or less, about 8 hours or less, about 7 hours or less, about 6 hours or less, about 5 hours or less, about 4 hours or less, about 3 hours or less, about 2 hours or less, about 1 hour or less, or about 30 minutes or less.

The above-mentioned induction heating conditions, for example, the applied current, the frequency and the application time, and the like may be changed in consideration of the kind and the ratio of the conductive magnetic metal, as described above.

In one example, the induction heating may be performed stepwise in at least two stages in consideration of removal efficiency of the polymer foam or the like in the sintering process. For example, the induction heating step may comprise a first induction heating step and a second induction heating step, which is performed under conditions different from the first induction heating step.

Here, the first and second induction heating conditions are not particularly limited.

For example, in the above first induction heating, the electromagnetic field can be formed by applying a current in a range of 100 to 500 A. Such an electromagnetic field can be formed, for example, by applying a current at a frequency in a range of about 200 to 500 kHz. The first induction heating can be performed by applying the electromagnetic field for a time in a range of about 30 seconds to 1 hour.

After the first induction heating is performed in this manner, the second induction heating can be performed under conditions different from the above. Here, the fact that the first and second induction heating conditions are different may mean that at least one of the magnitude and frequency of the current applied for application of the electromagnetic field is different.

The second induction heating step may be performed, for example, by applying a current in a range of 100 A to 1,000 A. In this case, the electromagnetic field can be formed by applying a current at a frequency in a range of 100 kHz to 1,000 kHz. This second induction heating can be performed, for example, for a time in a range of about 1 minute to 10 hours.

The sintering of the green structure may be carried out only by the above-mentioned induction heating, or may also be carried out by applying an appropriate heat, together with the induction heating, that is, the application of the electromagnetic field, if necessary.

The present application also relates to a metal foam. The metal foam may be one manufactured by the above-mentioned method. Such a metal foam may comprise, for example, at least the above-described conductive magnetic metal. The metal foam may comprise, on the basis of weight, 30 wt % or more, 35 wt % or more, 40 wt % or more, 45 wt % or more, or 50 wt % or more of the conductive magnetic metal. In another example, the ratio of the conductive magnetic metal in the metal foam may be about 55 wt % or more, 60 wt % or more, 65 wt % or more, 70 wt % or more, 75 wt % or more, 80 wt % or more, 85 wt % or more, or 90 wt % or more. The upper limit of the ratio of the conductive magnetic metal is not particularly limited, and may be, for example, less than about 100 wt % or 95 wt % or less.

The metal foam may have a porosity in a range of about 40% to 99%. As mentioned above, according to the method of the present application, porosity and mechanical strength can be controlled, while comprising uniformly formed pores. The porosity may be 50% or more, 60% or more, 70% or more, 75% or more, or 80% or more, or may be 95% or less, or 90% or less.

The metal foam may also be present in the form of thin films or sheets. In one example, the metal foam may be in the form of a film or sheet. The metal foam of such a film or sheet form may have a thickness of 2,000 μm or less, 1,500 μm or less, 1,000 μm or less, 900 μm or less, 800 μm or less, 700 μm or less, 600 μm or less, 500 μm or less, 400 μm or less, 300 μm or less, 200 μm or less, 150 μm or less, about 100 μm or less, about 90 μm or less, about 80 μm or less, about 70 μm or less, about 60 μm or less, or about 55 μm or less. For example, the film or sheet shaped metal foam may have a thickness of about 10 μm or more, about 20 μm or more, about 30 μm or more, about 40 μm or more, about 50 μm or more, about 100 μm or more, about 150 μm or more, about 200 μm or more, about 250 μm or more, about 300 μm or more, about 350 μm or more, about 400 μm or more, about 450 μm or more, or about 500 μm or more.

The metal foam may have excellent mechanical strength, and for example, may have a tensile strength of 2.5 MPa or more, 3 MPa or more, 3.5 MPa or more, 4 MPa or more, 4.5 MPa or more, or 5 MPa or more. Also, the tensile strength may be about 10 MPa or more, about 9 MPa or more, about 8 MPa or more, about 7 MPa or more, or about 6 MPa or less. Such a tensile strength can be measured, for example, by KS B 5521 at room temperature.

Such metal foams can be utilized in various applications where a porous metal structure is required. In particular, according to the method of the present application, it is possible to manufacture a thin film or sheet shaped metal foam having excellent mechanical strength as well as the desired level of porosity, as described above, thus expanding applications of the metal foam as compared to the conventional metal foam.

Advantageous Effects

FIG. 1 is a SEM photograph of a metal foam formed in an example.

BRIEF DESCRIPTION OF DRAWINGS

The present application can provide a method for manufacturing a metal foam, which is capable of forming in a very short time a metal foam comprising uniformly formed pores and having excellent mechanical properties as well as the desired porosity, and a metal foam produced by the above method. In addition, the present application can provide a method capable of forming a metal foam in which the above-mentioned physical properties are ensured, while being in the form of a thin film or sheet, in a short time, and such a metal foam.

MODE FOR INVENTION

Hereinafter, the present application will be described in detail by way of examples and comparative examples, but the scope of the present application is not limited to the following examples.

Example 1

A polymer foam is a polyurethane foam, which is in the form of a sheet having a thickness of about 5 mm. Titanium was sputtered on the surface of the polyurethane foam by a known method to form a thin film having a thickness of about 100 nm. Then, the polyurethane foam in which the titanium was sputtered on the surface was placed in a solution in which $NiSO_4$, $NiCl_2$ or $H_2BO_3$ and the like was dissolved, and the surface of the relevant polyurethane foam was plated with nickel by an electrolytic plating method in which a platinum electrode and the polyurethane foam were applied as an anode and a cathode, respectively. After the plating was performed for about one hour, the plated polyurethane foam was taken out, and then removal of the polyurethane foam and sintering of nickel were performed by induction heating under an atmosphere of $H_2/N_2$. The electromagnetic field for induction heating was formed by applying a current of about 350 A at a frequency of about 380 kHz, and the electromagnetic field was applied for about 3 minutes. Through the above steps, a sheet having a thickness of about 4.2 mm in a film form was produced. The produced sheet had a porosity of about 93%. FIG. 1 is a photograph of the metal foam produced in the example.

Example 2

A metal foam was produced in the same manner as in Example 1, except that an acrylic foam was used as the polymer foam. The produced metal foam in the film form had a thickness of about 4.5 mm and a porosity of about 95%.

Comparative Example 1

The nickel plated polyurethane foam produced in the same manner as in Example 1 was applied to a resistance heating oven and sintered. It took about 6 hours to produce a metal foam having physical properties similar to those of Example 1 through such a process.

What is claimed is:

1. A method for manufacturing a metal foam, the method comprising:

applying an electromagnetic field to a green structure comprising a polymer foam, said polymer foam comprising a surface with a layer of a metal component, and said metal component comprising a conductive metal having a relative magnetic permeability of 90 or more; and sintering the metal component with heat generated by induction heating of the conductive metal, wherein the sintering of the green structure is carried out only by the induction heating, wherein the polymer foam decomposes during said sintering, to thereby manufacture the metal foam, wherein the green structure is formed by plating the metal component on the polymer foam, wherein the plating is an electrolytic plating, wherein the electromagnetic field is formed by applying a current in a range of 250 A to 400 A and at a frequency in a range of 250 kHz to 400 kHz, wherein the electrolytic plating is carried out by forming a titanium film on the polymer foam, and then electrolytically plating the conductive metal on the polymer foam, and wherein the electromagnetic field is applied for a time of about 1 minute to 30 minutes.

2. The method for manufacturing a metal foam according to claim 1, wherein the polymer foam is a polyurethane foam, an acrylic foam, a polystyrene foam, a polyolefin foam, a polycarbonate foam, or a polyvinyl chloride foam.

3. The method for manufacturing a metal foam according to claim 1, wherein the conductive metal has a conductivity of 8 MS/m or more at 20° C.

4. The method for manufacturing a metal foam according to claim 1, wherein the conductive metal is nickel, iron or cobalt.

5. The method for manufacturing a metal foam according to claim 1, wherein the metal component comprises 30 wt % or more of the conductive metal.

6. The method for manufacturing a metal foam according to claim 1, wherein the induction heating comprises a first induction heating, and a second induction heating performed under conditions different from the first induction heating.

7. The method for manufacturing a metal foam according to claim 1, wherein the polymer foam is in the form of a film or sheet, and the metal foam produced is in the form of a film or sheet.

8. The method for manufacturing a metal foam according to claim 1, wherein the metal foam is in the form of a film or sheet having a thickness of 2,000 μm or less.

9. The method for manufacturing a metal foam according to claim 1, wherein the conductive metal is nickel.

10. The method for manufacturing a metal foam according to claim 1, wherein the porosity of the metal foam is 93% or more.

* * * * *